US008186732B2

(12) United States Patent
Gillesse

(10) Patent No.: US 8,186,732 B2
(45) Date of Patent: May 29, 2012

(54) CLAMPING DEVICE

(75) Inventor: Cornelis Nicolaas Gillesse, Arnhem (NL)

(73) Assignee: The Crosby Group LLC, Tulsa, OK (US)

( * ) Notice: Subject to any disclaimer, the term of this patent is extended or adjusted under 35 U.S.C. 154(b) by 375 days.

(21) Appl. No.: 12/448,084

(22) PCT Filed: Dec. 7, 2007

(86) PCT No.: PCT/NL2007/050629

§ 371 (c)(1),
(2), (4) Date: Aug. 10, 2009

(87) PCT Pub. No.: WO2008/069664

PCT Pub. Date: Jun. 12, 2008

(65) Prior Publication Data

US 2010/0066110 A1 Mar. 18, 2010

(30) Foreign Application Priority Data

Dec. 8, 2006 (NL) ..... 2000364

(51) Int. Cl.
*B66C 1/48* (2006.01)

(52) U.S. Cl. ..... 294/101; 294/104; 294/901

(58) Field of Classification Search ..... 294/101, 294/104, 901, 902, 103.1
See application file for complete search history.

(56) References Cited

U.S. PATENT DOCUMENTS

| | | | | | |
|---|---|---|---|---|---|
| 2,360,602 | A | * | 10/1944 | Waldrup | 294/104 |
| 3,274,657 | A | * | 9/1966 | Renfroe | 294/104 |
| 3,843,186 | A | * | 10/1974 | Van de Wetering | 294/101 |
| 4,273,373 | A | * | 6/1981 | van de Wetering | 294/101 |
| 4,641,877 | A | | 2/1987 | Merrill | |
| 4,884,836 | A | * | 12/1989 | Maye et al. | 294/101 |
| 2006/0061112 | A1 | * | 3/2006 | Schon | 294/101 |

FOREIGN PATENT DOCUMENTS

DE 1126098 B 3/1962

(Continued)

OTHER PUBLICATIONS

Database WPI Week 198042, Derwent Publications Ltd., London, GB, 1980-K1064C, XP002442524 & SU 718361A (Rogovets T P), Feb. 28, 1980 abstract, figure 1.

*Primary Examiner* — Dean Kramer
(74) *Attorney, Agent, or Firm* — Head, Johnson & Kachigian, P.C.

(57) ABSTRACT

A hoist clamp device for clamping an object. The device includes a frame, a first clamping part, movably connected to the frame and provided with a first gripping surface, a second clamping part, coupled to the frame, provided with a second gripping surface, and arranged with respect to the first clamping part so as to clamp the object between the second gripping surface and the first gripping surface, in which the first clamping part is movable with respect to the second clamping part in order to clamp the object by moving the first clamping part from a free position into a clamping position, and in which the second clamping part is furthermore provided with a gripping part, provided with the second gripping surface, which gripping part is designed to allow a displacement with respect to the frame as long as a clamping force of the first clamping part on the second clamping part is below a minimum value.

4 Claims, 12 Drawing Sheets

FOREIGN PATENT DOCUMENTS

| | | | |
|---|---|---|---|
| EP | 0003538 | A1 | 8/1979 |
| GB | 1385772 | A | 2/1975 |
| NL | 1385772 | | 4/1972 |
| NL | 7414215 | | 10/1974 |
| NL | 7406218 | A | 11/1974 |
| NL | 7610714 | A | 4/1977 |
| SU | 718361 | | 9/1978 |

* cited by examiner

CLAMPING DEVICE

BACKGROUND OF THE INVENTION

The invention relates to a clamping device for clamping an object, preferably plate material, to a clamping portion of said object.

Such clamping devices are in particular intended for use with loading and unloading devices, such as cranes and lifting gear for lifting plate-like material, such as metal plates, elongate objects, etc. With the clamping device, it is also possible to lift or displace objects having a part which is suitable to be clamped.

Such a clamping device is known, for example, from U.S. Pat. No. 4,641,877 and NL-A-7414215. These documents describe a clamping device which is provided with a first clamping part and a second clamping part. The first clamping part is rotatably connected to a frame and connected to a movable lifting eye by means of an arm. If, for example, a panel is positioned between the clamping parts, the lifting eye will slide in the frame when the clamping device is lifted, as a result of which the arm will cause the first clamping part to rotate. As a result thereof, teeth of the first clamping part will contact the plate, will lock onto the plate, and in addition the first clamping part will exert a force on the plate in the direction of the second clamping part so that the plate is clamped between the first and second clamping part. In order to achieve a sufficiently strong clamping action, the object to be lifted has to have a minimum weight. In particular with thin and lightweight plate material, it has been found that the clamping action is in many cases insufficient. Consequently, in addition to a maximum acceptable weight (also referred to as the work load limit or WLL), a minimum acceptable load will be specified for a clamping device. Depending on the hardness of the material to be clamped, this may be 5-10% of the WLL.

GB-A-1,385,772 of applicant discloses a hoist clamp for clampingly gripping plates. That hoist clamp comprises a toggle lever system, pivotally coupled. A first lever of this system being pivotally connected to a hoisting eye by means of a pin movable in a slot formed in the side of the clamp. A second lever is coupled to an axis which has a fixed position with respect to the side of the clamp and has a working surface which is eccentric with respect to the axis. The clamp further has a pressure surface on a wedge which has a toothing on its slanted side. Fixedly coupled to the side of the clamp is a member, also having a toothing, and on the member the wedge is slidingly mounted with the toothed sides directed towards each other. The wedge is spring-biased downwardly. The toothing is such that when a pressure force is applied, the toothing blocks upward movement of the wedge on the member. A further lever can block the wedge in its upward position.

When a plate is positioned between the working surface and the pressure surface, the wedge is released using the further lever, and the wedge is pressed downward, clamping the plate. Another lever, blocking the toggle lever system, is now released. When starting to hoist, the toggle levers are pulled, transferring the hoisting force to the working surface, this strongly clamping the plate between the working surface and pressure surface.

A disadvantage of this construction is that this clamp does not allow relatively light objects to be hoisted securely: The clamping force during hoisting always depends on the weight of the object.

SUMMARY OF THE INVENTION

It is an object of the invention to provide a clamping device having an improved clamping action of mainly lightweight objects, in particular lighter plates.

It is a further object of the invention to provide a clamping device with a lower minimum load, but without compromising its performance for regular loads.

To this end, the invention provides a hoist clamp device for hoisting and clamping an object, such as a plate, comprising a frame provided with a slot for accommodating at least part of the object, a first clamping part, pivotably connected to the frame on one side of the slot and to a first gripping surface directed towards the slot, a second clamping part connected to the frame and to a second gripping surface directed towards the first gripping surface, with the gripping surface on the first clamping part on an increasing radius with respect to the pivot axis, and in which the second clamping part comprises a carrier part which is connected to the frame and a gripping part provided with the second gripping surface, coupled to the carrier part, and the second clamping part is furthermore provided with a sliding part having a sliding surface which is displaceable with respect to the gripping part and covers said gripping surface as long as a force on the sliding surface is below a minimum value.

To another extend, the same object of providing a hoist clamp device which allows relatively light objects to be clamped and lifted, the invention provides a hoist clamp device for clamping an object, preferably plate material, to a clamping portion, comprising a frame, a first clamping part, movably connected to the frame and provided with a first gripping surface, a second clamping part, coupled to the frame, provided with a second gripping surface, and arranged with respect to the first clamping part so as to clamp the clamping portion of the object between the second gripping surface and the first gripping surface, in which the first clamping part is movable with respect to the second clamping part in order to clamp the clamping portion of the object by moving the first clamping part from a free position into a clamping position, and in which the second clamping part is furthermore provided with a gripping part, provided with the second gripping surface, which gripping part is designed to allow a displacement with respect to the frame away from the first gripping surface as long as a clamping force of the first clamping part on the second clamping part is below a minimum value.

The prior art clamping device, for example from U.S. Pat. No. 4,641,877 and NL 7414215, for example for lifting a plate, operates as follows. The plate is positioned between the clamping parts and the first clamping part will pivot in such a manner that its gripping surface will touch the surface of the plate. Both surfaces of the plate now bear against the gripping surface of the first and second clamping part, respectively. During lifting, for example, the first clamping part will pivot further. As a result thereof, the distance between the gripping surface of the first clamping part and the gripping surface of the second clamping part will be reduced. Teeth of the gripping surfaces now penetrate the plate surface slightly, firstly because the plate moves slightly with respect to the gripping surface, secondly because due to the first clamping part pivoting, the latter exerts a force onto the plate in the direction of the gripping surface of the second clamping part.

It has been found that such a mechanism is effective in the case of heavy plates, but not when, for example, lightweight plates have to be lifted. It has been found that it is preferable in such a situation if the gripping surface of the first clamping part contacts the plate surface first, so that said surface bears against the surface of the plate well, while the surface of the second clamping part has as little friction as possible with respect to the plate surface. As a result, the plate may slide slightly with respect to the first gripping surface, which may result, for example, in teeth of the first gripping part penetrating into the material. The gripping surface of the second clamping part will contact the plate surface if first clamping part has sufficient grip on the plate surface and the second clamping part exerts a specific minimum force on the plate in the direction of the second gripping surface.

With the known clamping device, for example in particular with the relatively small clamps (WLL of 0.5 & 1 ton), it is possible that the clamps cannot be used in certain cases. If, for example, a steel plate having a thickness of 1 mm and dimensions of 1 by 2 metres is to be lifted, its weight (if lifting is carried out in the vertical direction) is 160 N. If a clamp of 0.5 T is used, the weight has to be 5% of the WLL, and therefore at least 250 N. The plate in question can then not be lifted. As a result of the insight which has been explained above, it becomes possible to provide a clamping device with a minimum acceptable load which is much lower than is customary, even a minimum acceptable load of 0 (zero) (or almost zero) seems possible, that is to say no lower limit.

In an embodiment, the sliding surface extends towards the surface of the clamping part past the gripping surface of the gripping part.

In an embodiment, the sliding surface of the sliding part is displaceable with respect to the gripping surface of the gripping part with a directional component which is at right angles, i.e. substantially perpendicular, to the gripping surface.

In an embodiment, the sliding part is displaceable with respect to the gripping part, so that when an object is clamped, the sliding surface contacts the object and not the gripping surface, as long as the clamping force of the first clamping part on the second clamping part is below a minimum value.

In an embodiment, or an embodiment of the previous, the gripping part is displaceable with respect to the second clamping part.

In an embodiment, the second clamping part furthermore comprises a spring means, and a gripping part is spring mounted with respect to the further second clamping part by means of the spring means.

In a embodiment, the gripping part is pre-biased by the spring means. This allows a predefined definition of the clamping force as long as it is below a certain minimum level. The spring means can be a compression of extension spring, a (set of) disc-spring(s), torsion spring(s), but the pre-biasing can also be result from a compressible, flexible ("rubbery") synthetic, in particular polymer material, or natural polymer material, for instance natural rubber. In the description of embodiments, several further examples are provided.

In an embodiment, the gripping part is attached to the second clamping part so as to be movable with respect to the frame, and a spring means pre-biased the gripping part.

In an embodiment, the second clamping part furthermore comprises a sliding part having a sliding surface which extends towards the surface of the clamping part past the gripping surface of the gripping part.

In an embodiment, the sliding surface of the sliding part is displaceable with respect to the gripping surface of the gripping part with a directional component which is at right angles to the gripping surface.

In an embodiment, the sliding part is displaceable with respect to the gripping part, so that when an object is clamped, the sliding surface contacts the object and not the gripping surface, as long as the clamping force of the first clamping part on the second clamping part is below a minimum value.

To another aspect, the invention relates to a clamping device for an object, such as a plate, comprising a frame provided with a slot for accommodating at least part of the object, a first clamping part, pivotably connected to the frame at one side of the slot and to a first gripping surface directed towards the slot, a second clamping part connected to the frame and to a second gripping surface directed towards the first gripping surface, with the gripping surface on the first clamping part at an increasing radius with respect to the pivot axis, and in which the second clamping part comprises a carrier part which is connected to the frame and a gripping part provided with the second gripping surface, coupled to the carrier part, in which the gripping part is movable with respect to the carrier part.

Further embodiments and elaborations of the invention are described in the dependent claims and in the embodiments.

It will be clear that the various aspects mentioned in this patent application can be combined and may each be separately considered for a divisional patent application.

BRIEF DESCRIPTION OF THE DRAWINGS

The attached figures illustrate various embodiments of a clamping device according to the invention, in which.

DESCRIPTION OF EMBODIMENTS

Figure 1:
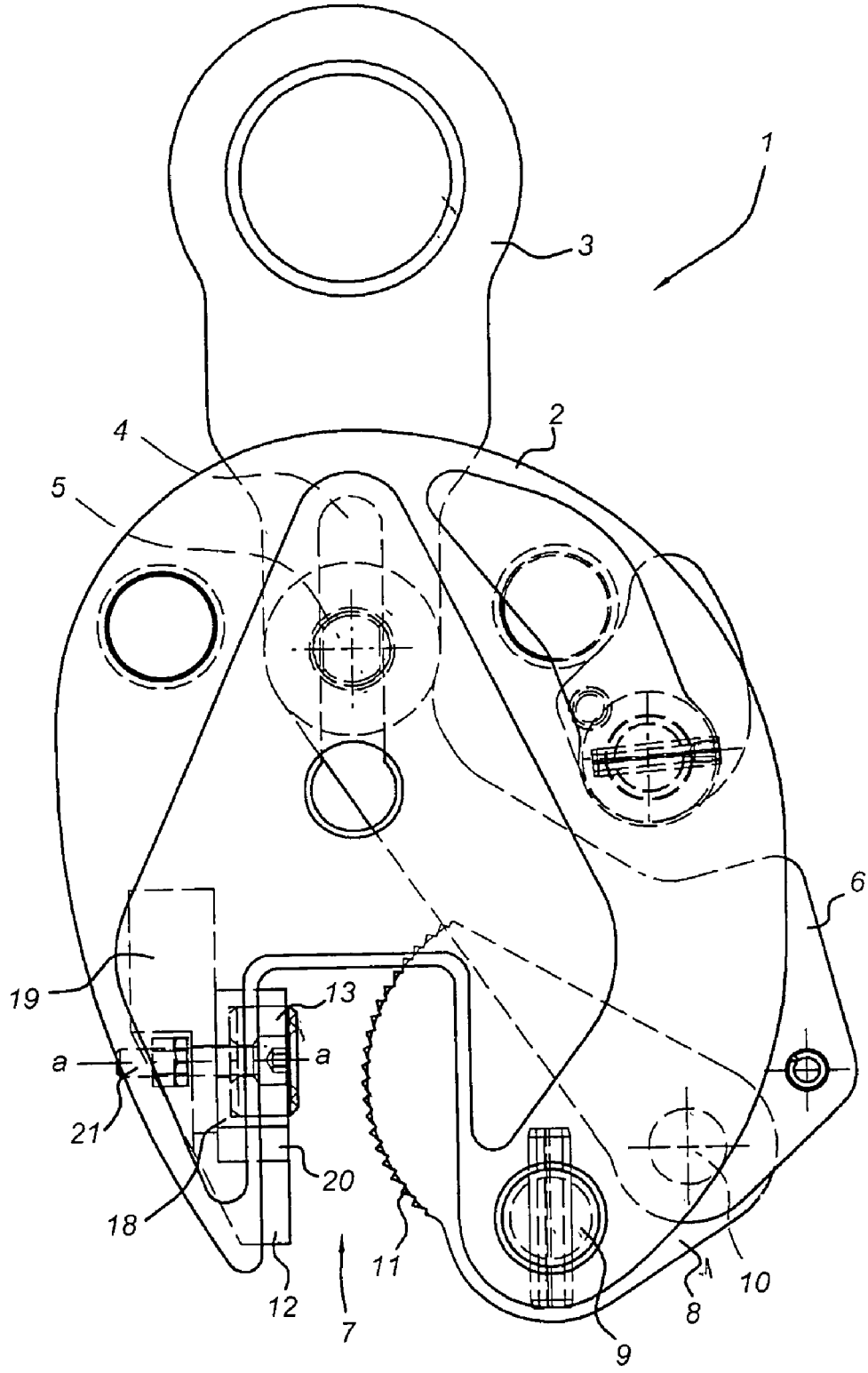
FIGS. 1-3*a* shows various views of a first embodiment of a clamping device having a clamping part with a gripping surface which can be displaced up to a minimum load.

The figures show an example of a clamping device according to the invention, with the invention in this case being used in a traditional clamping device, also referred to as a plate clamp or lifting clamp. In this description of the figures, similar parts are denoted by identical reference numerals. The figures will initially be described in general as the embodiments illustrated here are all based on the same basic type of lifting clamp.

The figures show a clamping device 1 having a frame 2, with frame parts 2 and 2', in which a lifting eye 3 is arranged so as to be movable along a straight line part by means of a slotted hole 4 and guide 5. The lifting eye 3 is operatively connected to an operating arm 6.

The frame 2 has a slot 7 for accommodating a part of an object which has to be clamped and consequently has two legs on either side of the slot 7.

A first clamping part 8 on a rotary shaft 9 is pivotably or rotatably connected to the frame 2. Clamping part 8 is furthermore connected to the operating arm 6 by means of a rotary shaft 10, at a distance from the rotary shaft 9.

Clamping part 8 has a gripping surface 11 which is situated at an increasing distance to the rotary shaft 9. The distance in this case increases as the slot 7 is entered. The frictional resistance of the gripping surface is high here due to a toothing. The gripping surface 11 in this case has teeth, preferably gripping in the direction of the slot 7 or out of slot 7. It is also possible to have a gripping surface 11 different from that shown, preferably a gripping surface 11 which results in less friction in the direction into the slot 7 than in the direction out of the slot 7.

Situated in the slot 7 opposite the first clamping part 8 is a second clamping part 12. Said second clamping part is provided with a gripping part 13 having a gripping surface.

The clamping device is furthermore provided with a lock in order to lock the operating arm in position and thus lock the first clamping part in position.

The operation when lifting, for example, a heavy plate, is as follows. In the at-rest position, the lifting eye 3 and the guide 5 can rest at the bottom of the slotted hole. As a result, that part of the first gripping surface 11 which is closest to the rotary shaft 9, will be closest to the second gripping surface. The distance between the gripping surfaces will approximately be at a maximum. The guide 5 is freely movable inside the slotted hole 4, as a result of which the operating arm 6 can move freely and can thus cause the first clamping part 8 to pivot about the rotary shaft 9. If, for example, a plate is placed in the slot 7 and frame 2 rests on the plate, the lifting eye 3 can be moved with respect to the plate and frame 2 with the guide 5 moving into the slotted hole 4 towards the side which is turned away from the slot 7. Consequently, the first clamping part, actuated by operating arm 6, will pivot about rotary shaft 9. As a result thereof, due to the increasing distance between the gripping surface 11 and the rotary shaft 9, the distance between the gripping surfaces will be reduced until both surfaces of the clamping parts 8 and 13 bear against the plate surfaces. As lifting continues, the force which the clamping part 8 exerts on the plate surface increases. The teeth of gripping surface 11 penetrate into the surface, and through the weight of the plate, the first clamping part 8 is subjected to a force in the direction out of the slot 7. This force results in a force which forces the plate against the second clamping part, as a result of which the toothing of the second gripping surface also penetrates into the surface of the plate material, thus producing a certain, secure clamping action.

Figure 2:
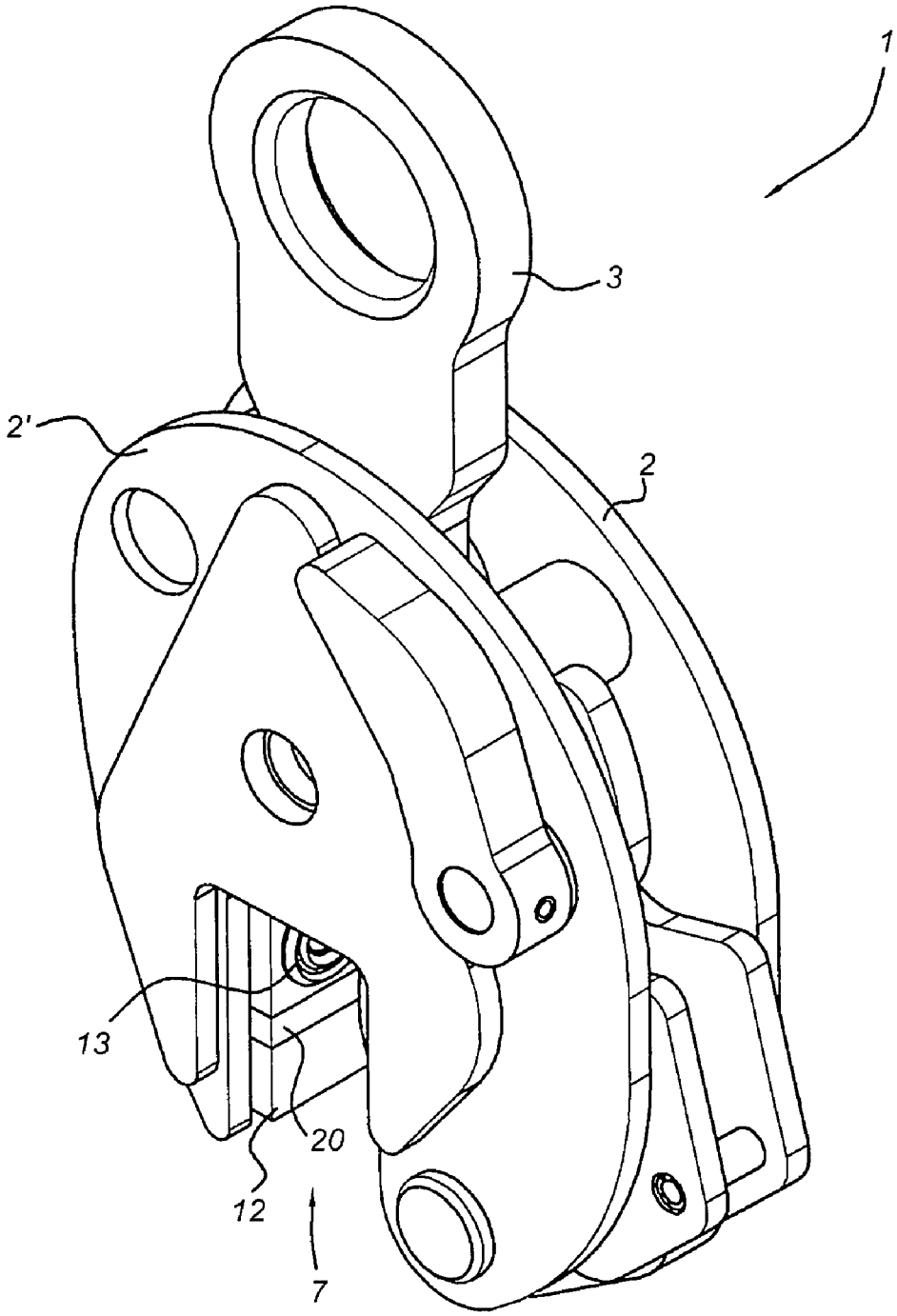
Figure 3:
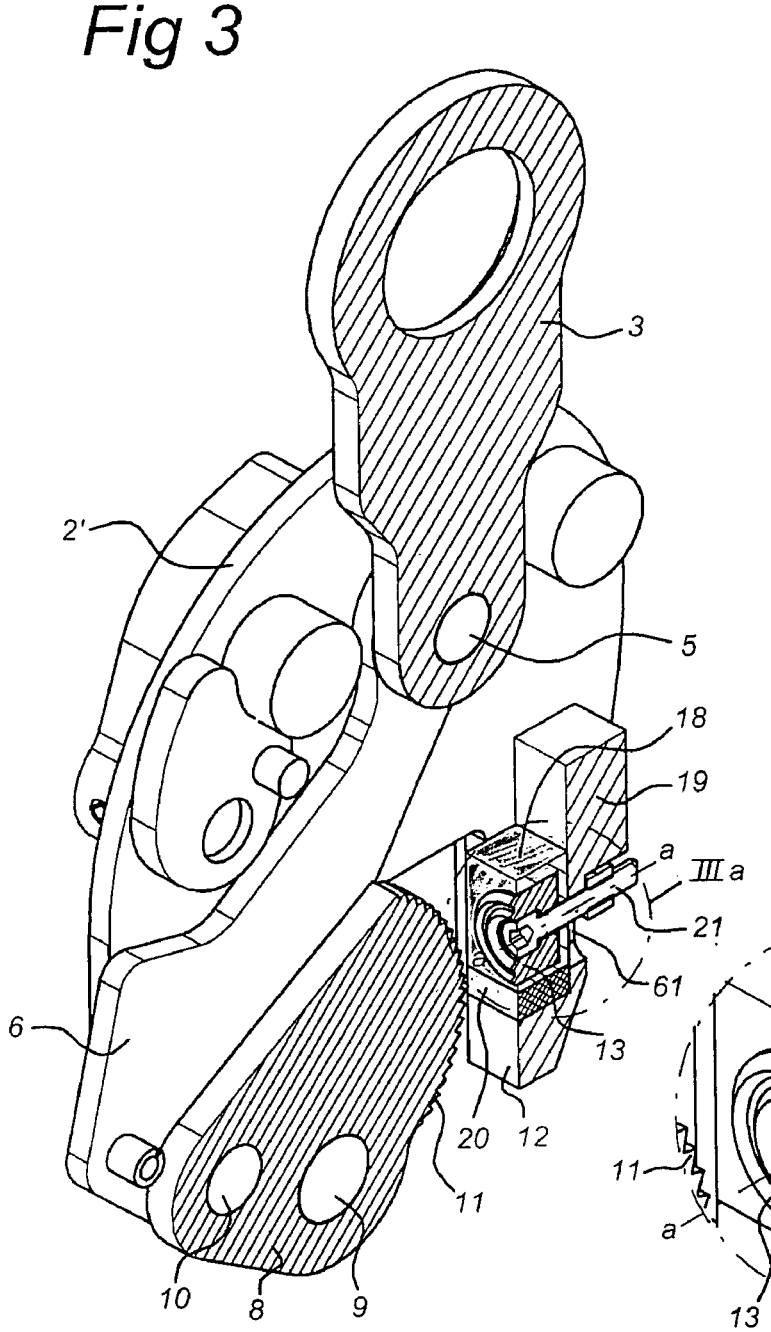
Figure 3A:
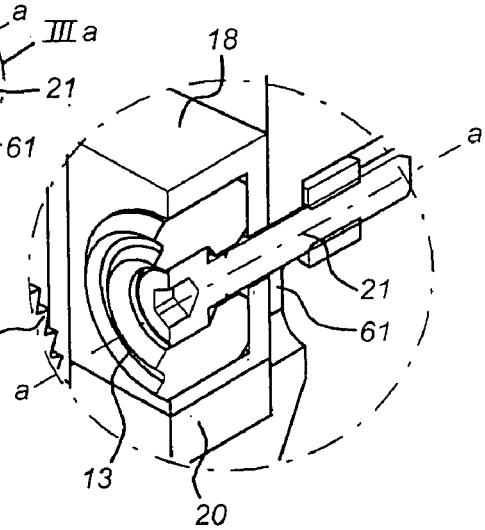

FIGS. 1-3*a* show a first embodiment of a clamping device according to the invention. FIG. 1 shows a side view, FIG. 2 shows a perspective view, FIG. 3 a partly cut-away view and FIG. 3*a* shows a detail thereof. In this embodiment, the clamping part 12 is provided with a gripping part 13 having a gripping surface. The gripping part 13 is mounted in a holder 18 which is slidable in the plane of the drawing and in this case is at right angles to the axis a. Below the holder 18 and between the holder 18 and carrier part 19 which is here fixedly connected to the frame 2, 2', a block of elastic material 20 is arranged. As a result, gripping part 13 is movable under pre-bias. Holder 18 is installed in carrier part 19 via shaft 21 which is slidable in slot 61. As an alternative, the for instance partially or completely surround holder 18.

If a load is clamped now which is smaller than the minimum working load, the block of elastic material will be compressed as a result of which the gripping part 13 moves along with an object to be clamped, up to a point where the spring force compensates for the weight. When the weight is greater than the spring force, the gripping part will not move (any longer).

Figures 4, 4A:
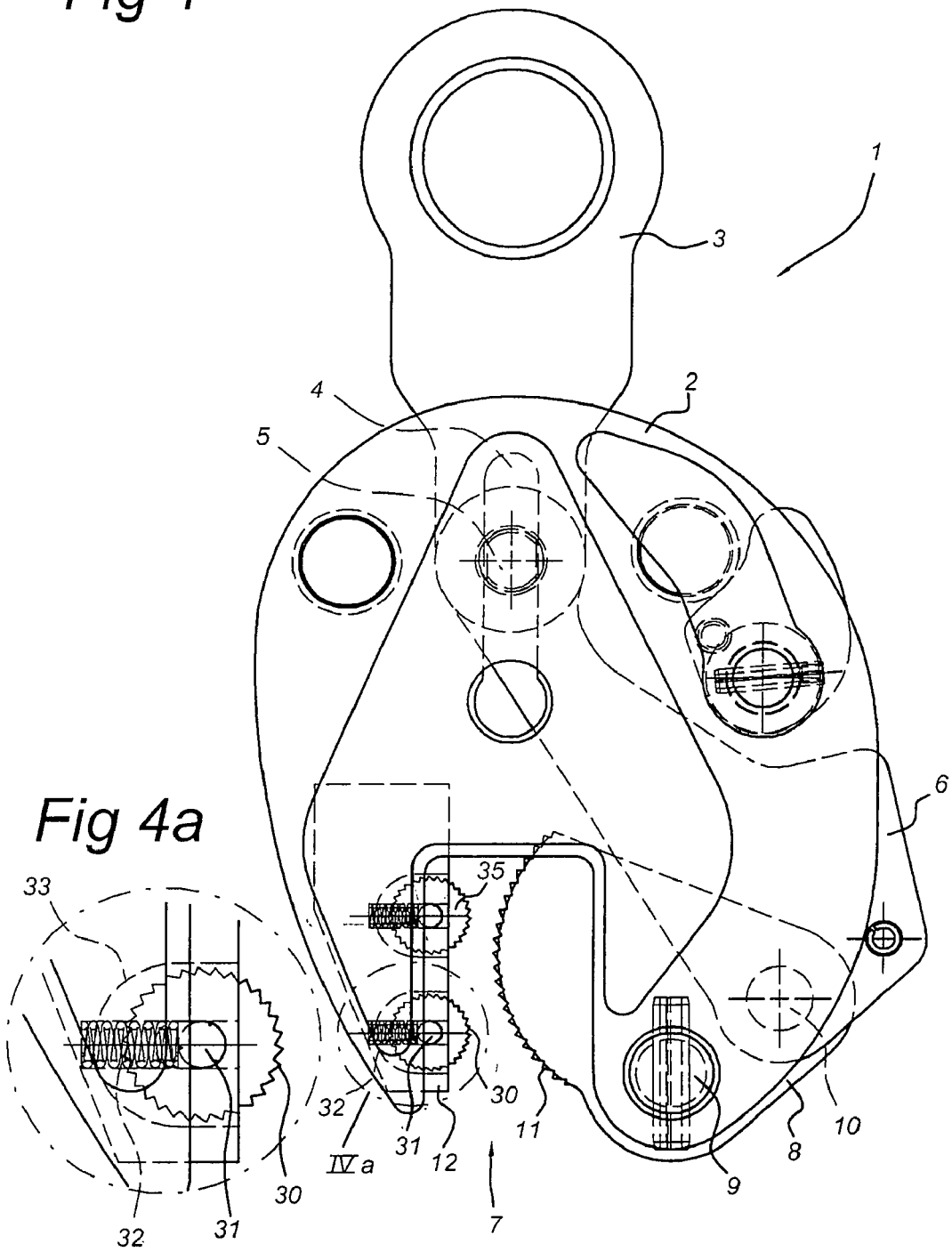
FIGS. 4, 4*a*, 5, and 6 show various views of a second embodiment of a clamping device having a clamping part with a sliding surface under spring load.
Figure 5:
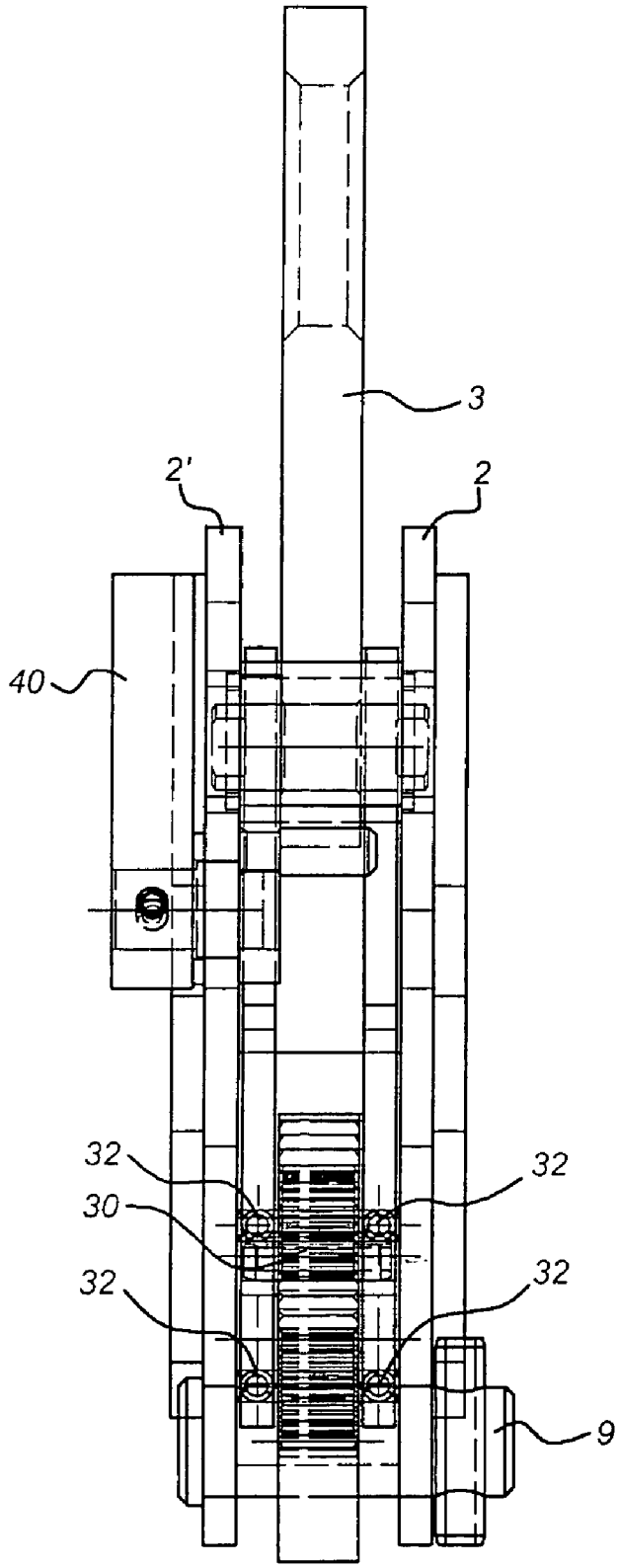
Figure 6:
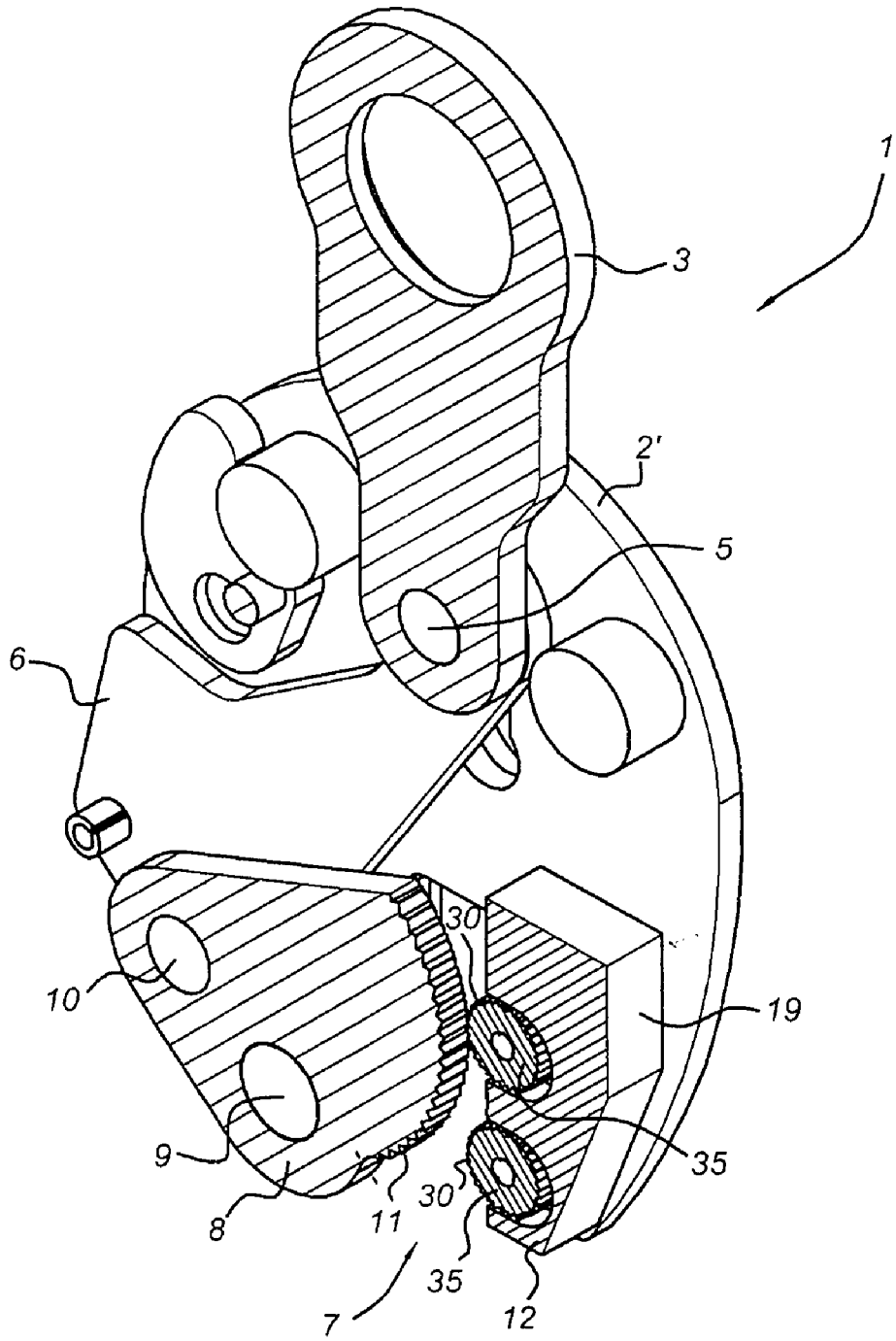

FIGS. 4-6 show a side view, detail (4*a*), a side view at right angles to FIG. 4 and partly exploded view in perspective.

In this embodiment, the clamping part 12 has a carrier part 19 which has toothed rollers 35 therein on a shaft 31 which is spring mounted by means of springs 32. The rollers are partly accommodated in a cavity in the carrier part 19. When a force is greater than the spring force, the surface 30 of the rollers will abut against surface 33 of the cavity and no longer be able to rotate about their axis.

Figure 7:
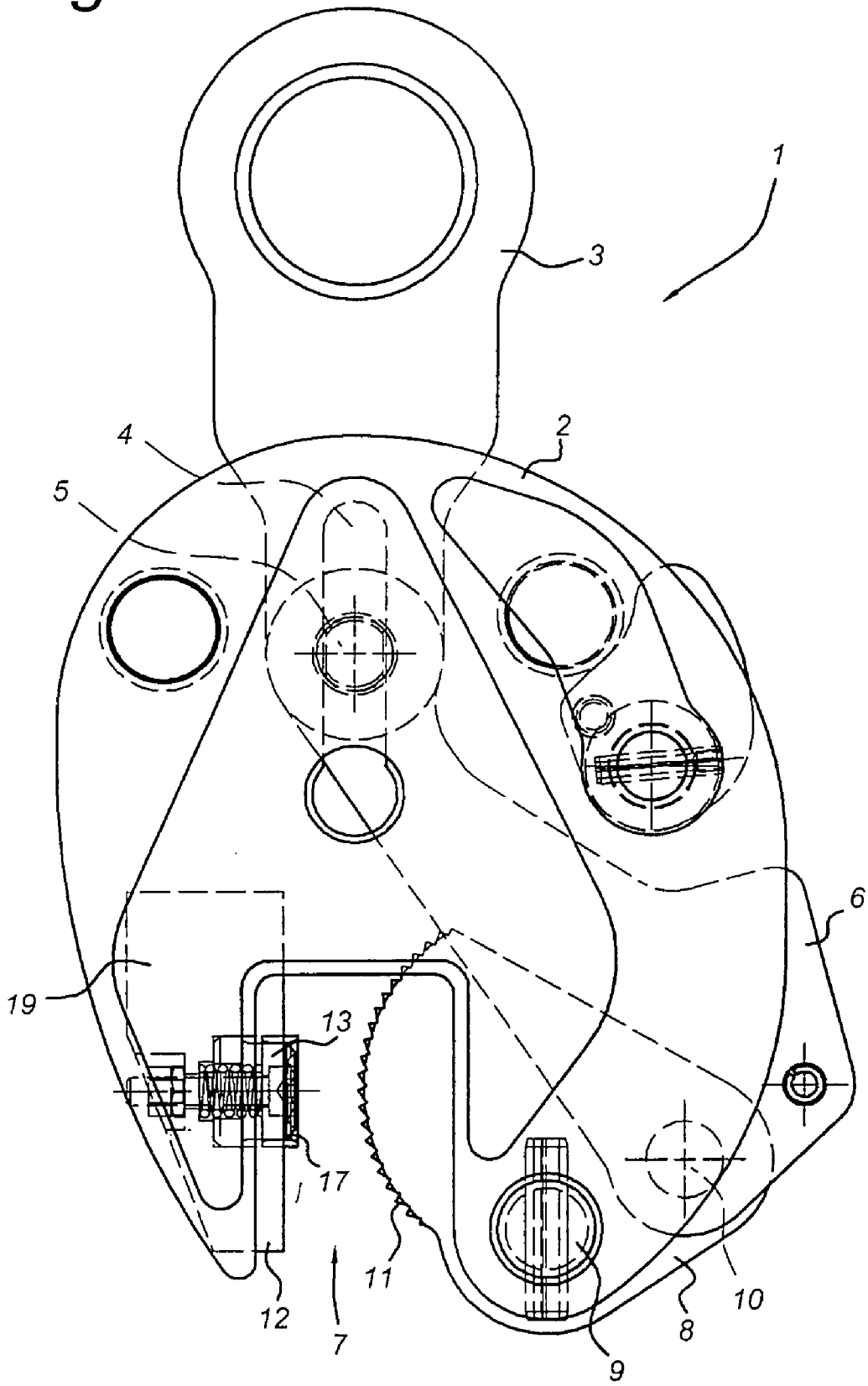
FIGS. 7-9*a* show various views of a third embodiment of a clamping device having a clamping part with a pre-biased sliding par.
Figure 8:
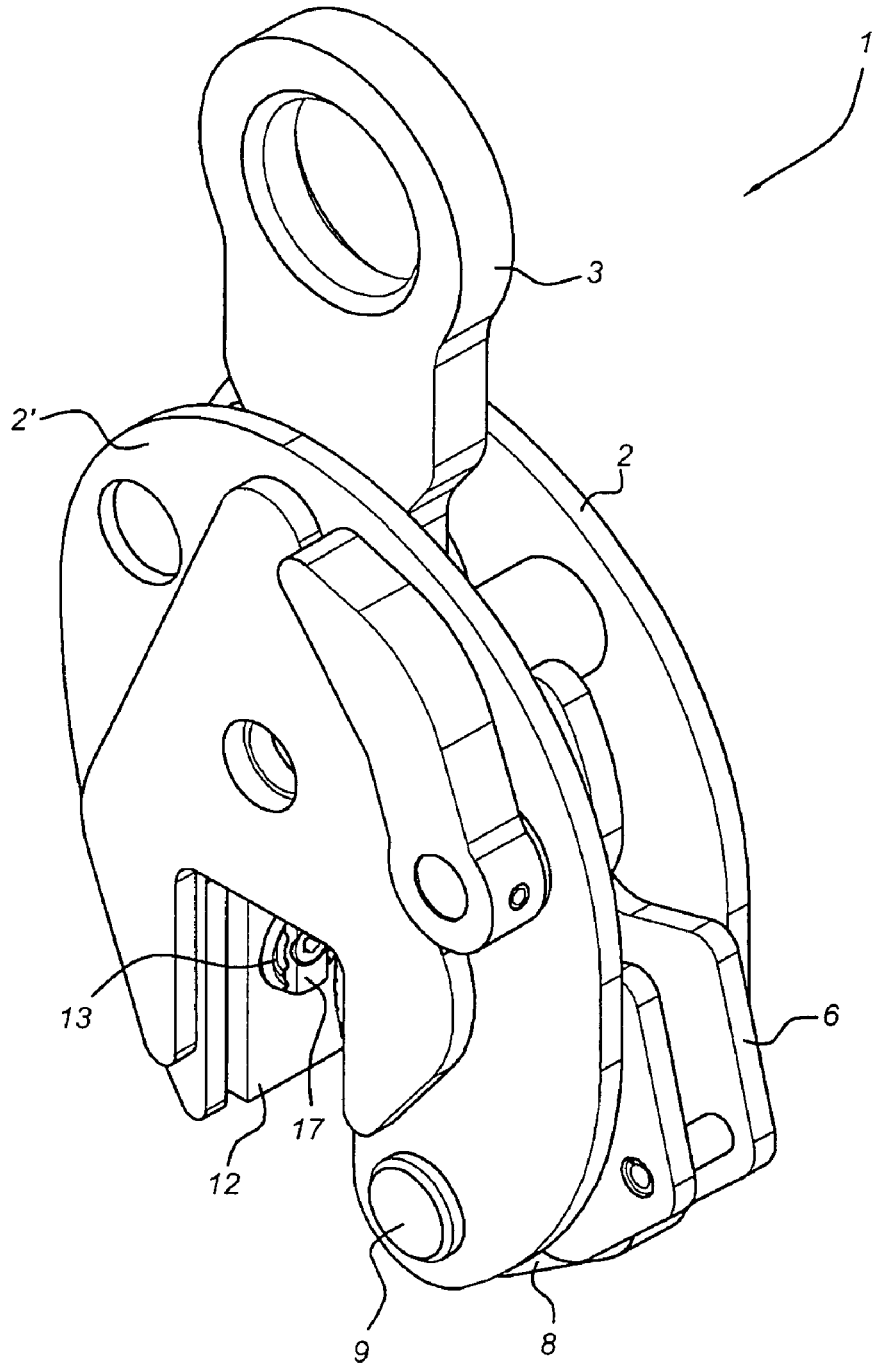
Figure 9:
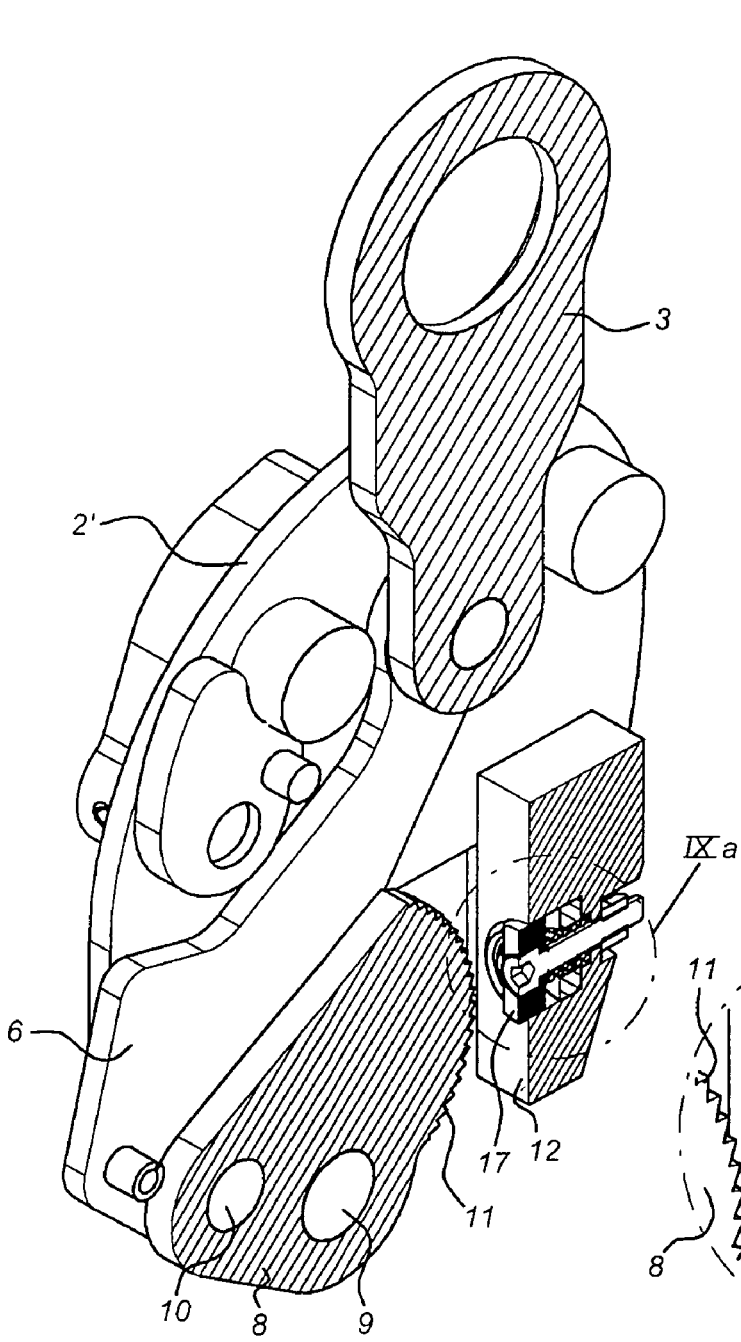
Figure 9A:
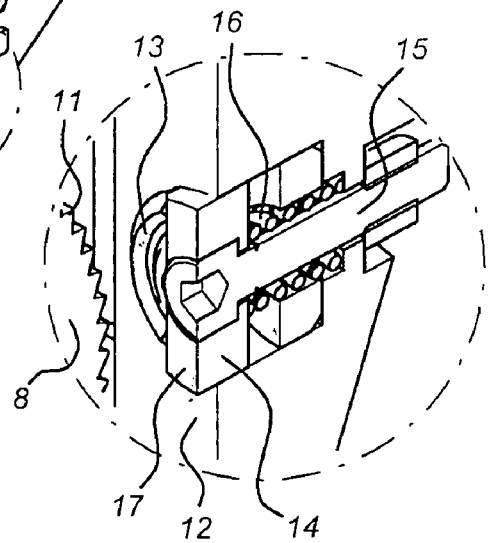

FIGS. 7-9*a* show views of an embodiment of the clamping device having a sliding part 14 in the gripping part 13. The sliding part 14 is prebiased by means of spring 16 on shaft 15. Sliding part 14 provides a prebiased sliding surface 17 which, in the at-rest position, protrudes beyond the gripping surface. FIG. 7 shows a side view, FIG. 8 shows a perspective view, FIG. 9 shows a cut-away view in which one part has been removed, and FIG. 9*a* shows a detail from FIG. 9.

In this case, the gripping part 13 here is provided with a slot in which a sliding part 14 is slidably accommodated. The sliding part 14 has a sliding part shaft 15 which can slide through clamping part 12. A spring 16 is placed on the sliding part shaft 15. The sliding part 14 is thus pre-biased, so that the sliding surface 17 thereof protrudes outside the gripping surface of gripping part 13. Thus, the frictional resistance or grip can be reduced to a minimum force which is to be exerted on the sliding surface. The sliding surface can be made of teflon, nylon, polyethylene (PE) or another plastic material with a low coefficient of friction, or for example steel or a corresponding low-friction material. In this embodiment, the gripping surface of gripping part 13 partly surrounds the sliding surface. The reverse solution is also possible, i.e. the sliding surface (partly or completely) surrounding the gripping surface. In any case, the sliding surface displaces from an extended position in which it (partly or completely) shields the gripping surface, to a retracted position where the gripping surface extends.

Figure 10:
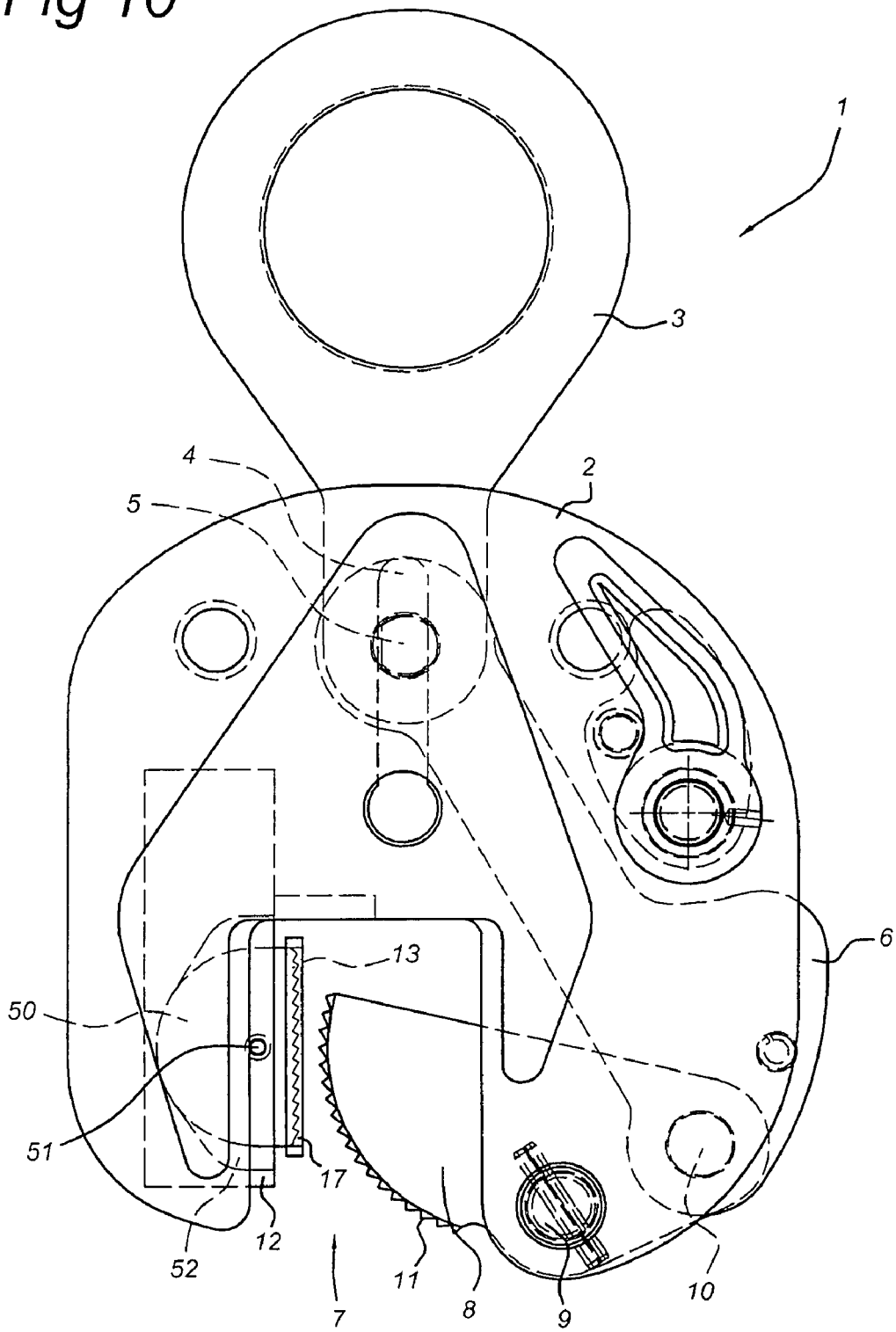
FIGS. 10-12 show various views of a fourth embodiment of a clamping device having a clamping part which is tiltable.
Figure 11:
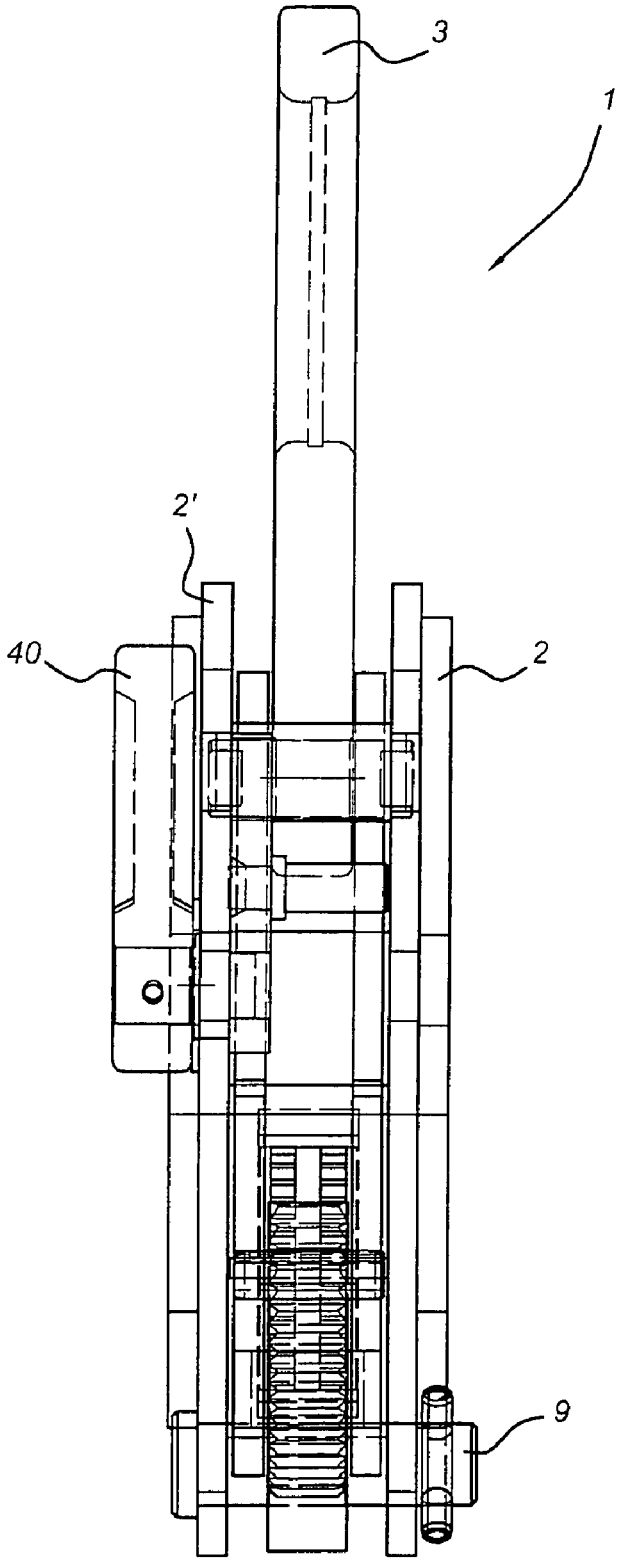
Figure 12:
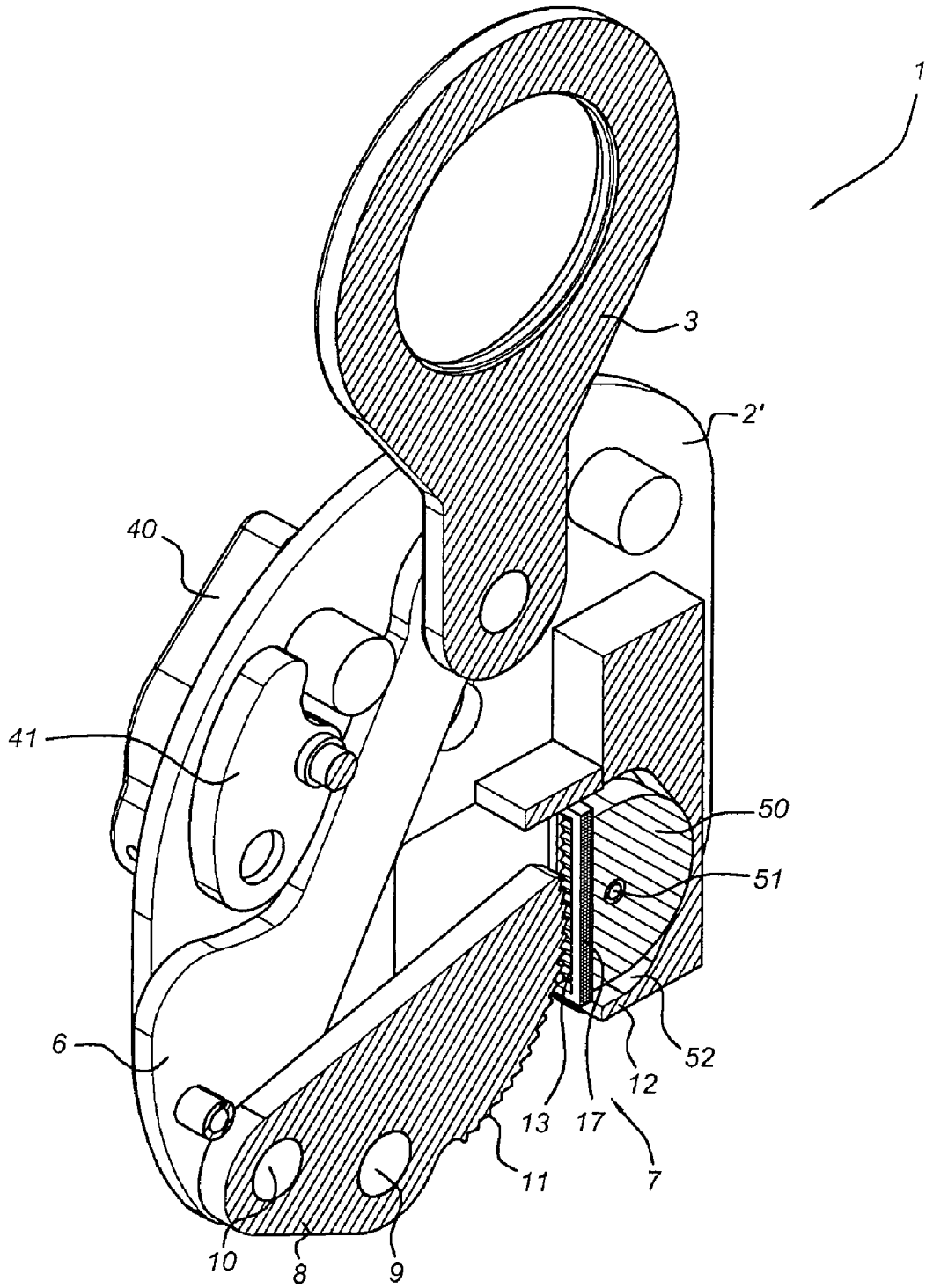

FIGS. 10-12 show a further alternative embodiment in side view, in another side view and in partly cut-away perspective view, respectively. In this case, the second clamping part 12 here comprises a pivotable gripping part 50 which can be pivoted about pivot 51. A compressible ring, here number 17, is arranged in the gripping surface 13, as a result of which the gripping surface, at a minimum pressure, does not touch the surface of an object to be clamped, and if the force is greater than said value, the gripping surface contacts the surface of the object which is to be clamped.

It will be clear that the above description has been given in order to illustrate the operation of preferred embodiments of the invention and not in order to limit the scope of the invention. On the basis of the explanation given above, many variations will be evident to the person skilled in the art, all of which are within the spirit and scope of the present invention.

The invention claimed is:

1. A hoist clamp device for clamping an object, comprising:

a frame;

a first clamping part, movably connected to the frame and provided with a first gripping surface;

a second clamping part, coupled to the frame, provided with a second gripping surface, and arranged with respect to the first clamping part so as to clamp the object between the second gripping surface and the first gripping surface, in which the first clamping part is movable with respect to the second clamping part in order to clamp the object by moving the first clamping part from a free position into a clamping position, and in which the second clamping part is furthermore provided with a gripping part, provided with the second gripping surface, which gripping part is designed to allow a displacement with respect to the frame away from the first gripping surface as long as a clamping force of the first clamping part on the second clamping part is below a minimum value, which gripping part is displaceable with respect to the second clamping part at a right angle;

wherein the second clamping part includes spring means and the gripping part is prebiased by the spring means.

2. The device according to claim 1, in which the second clamping part furthermore comprises a sliding part having a sliding surface which extends towards the surface of the second clamping part past the gripping surface of the gripping part.

3. The device according to claim 2, in which the sliding surface of the sliding part is displaceable with respect to the gripping surface of the gripping part with a directional component which is at right angles to the gripping surface.

4. The device according to one of claim 3 in which the sliding part is displaceable with respect to the gripping part, so that when an object is clamped, the sliding surface contacts the object and not the gripping surface, as long as the clamping force of the first clamping part on the second clamping part is below a minimum value.

* * * * *